US010644469B1

(12) United States Patent
Zhang et al.

(10) Patent No.: US 10,644,469 B1
(45) Date of Patent: May 5, 2020

(54) LED LAMP WITH ADAPTABLE PLUG-IN PIN CONFIGURATION

(71) Applicant: Green Creative, LTD, Hong Kong (CN)

(72) Inventors: Ryan Zhang, Shanghai (CN); Bertrand Delalande, Shanghai (CN)

(73) Assignee: Green Creative LTD., Hong Kong (CN)

( * ) Notice: Subject to any disclaimer, the term of this patent is extended or adjusted under 35 U.S.C. 154(b) by 0 days.

(21) Appl. No.: 16/501,388

(22) Filed: Apr. 4, 2019

(51) Int. Cl.

| | |
|---|---|
| ***H01R 29/00*** | (2006.01) |
| ***H01R 27/00*** | (2006.01) |
| ***H01R 13/08*** | (2006.01) |
| ***F21K 9/272*** | (2016.01) |
| ***H01R 13/502*** | (2006.01) |
| *F21Y 115/10* | (2016.01) |

(52) U.S. Cl.
CPC ..... *H01R 27/00* (2013.01); *F21K 9/272* (2016.08); *H01R 13/08* (2013.01); *H01R 13/502* (2013.01); *F21Y 2115/10* (2016.08)

(58) Field of Classification Search
CPC ..... H01R 13/08; H01R 13/502; H01R 27/00; F21K 9/272; F21Y 2115/10
USPC ..... 439/172, 173, 52, 131; 362/800
See application file for complete search history.

(56) References Cited

U.S. PATENT DOCUMENTS

| | | | | |
|---|---|---|---|---|
| 7,063,444 | B2 * | 6/2006 | Lee | F21L 14/00 362/184 |
| 8,186,857 | B2 * | 5/2012 | Porter | F21S 8/028 362/153.1 |
| 8,193,690 | B2 * | 6/2012 | Wursching | H01J 5/54 313/318.09 |
| 8,523,394 | B2 * | 9/2013 | Simon | F21V 25/04 362/249.05 |
| 8,602,803 | B2 * | 12/2013 | Fukano | H01R 33/9658 439/271 |
| 8,622,572 | B2 * | 1/2014 | Morgan | H05K 1/142 362/217.17 |
| 8,757,863 | B2 * | 6/2014 | Athalye | H01R 13/6658 362/650 |
| 8,860,309 | B2 * | 10/2014 | Huang | F21K 9/23 315/35 |
| 8,956,019 | B2 * | 2/2015 | Swedberg | F21K 9/272 439/374 |
| 9,028,105 | B2 * | 5/2015 | Barnetson | F21K 9/20 362/294 |
| 9,714,743 | B2 * | 7/2017 | Barnetson | F21V 3/062 |
| 9,801,241 | B2 * | 10/2017 | Hsia | F21V 25/04 |
| 9,913,330 | B2 * | 3/2018 | Hsia | H05B 33/0815 |
| 10,208,919 | B2 * | 2/2019 | Barnetson | F21K 9/20 |

(Continued)

*Primary Examiner* — Abdullah A Riyami
*Assistant Examiner* — Vladimir Imas
(74) *Attorney, Agent, or Firm* — James A. Gavney, Jr.; JAG Patent Services

(57) ABSTRACT

An LED plug-in lamp is disclosed that has a plug head which converts from a G24Q 4-pin plug head to a G24D type 2-pin plug head when a collar structure on the plug head is rotated relative to a fixed stage structure. The collar structure has two pin-stop features and two pin hole cover features. Rotating the collar structure relative to the fixed stage structure moves the two pin-stop features and allows the two reachable contact pins can be retracted through corresponding pin holes on the fixed stage structure and places ends of the pin hole cover structures over corresponding pin holes.

14 Claims, 10 Drawing Sheets

(56) References Cited

U.S. PATENT DOCUMENTS

2009/0261706 A1* 10/2009 Sorella ..... F21K 9/27
313/46
2010/0148673 A1* 6/2010 Stewart ..... H05B 33/0803
315/121

* cited by examiner

LED LAMP WITH ADAPTABLE PLUG-IN PIN CONFIGURATION

FIELD OF THE INVENTION

This invention is related to lighting. More specifically, this invention is related to light emitting diode plug-in lamps with adaptable contact pin configurations.

BACKGROUND OF THE INVENTION

Plug-in compact fluorescent lamps (CFLs) are plug-in-lamps (PLs) developed with plug-in bases that are attached to fluorescent tubes. The plug-in bases of the CFLs are designed to fit into the matched plug socket of a matched plug-in power outlet to replace traditional incandescent light bulbs. While CFLs last much longer and are more energy efficient than incandescent light bulbs, they are largely being replaced with light emitting diode (LED) PLs.

The plug-in base configuration used for a LED PL can depend on the type of ballasts being used in the fluorescent fixture that is being retrofitted. For example, where magnetic ballasts are being employed, the LED PL need to have a plug-in base with a 2-pin configuration. Where electronic or digital ballasts are being employed, the LED PL needs to have a plug-in base with a 4-pin configuration.

SUMMARY OF INVENTION

The present invention is directed to a LED plug-in lamp. The LED plug-in lamp includes a LED light engine that can have any suitable geometry for the application at hand including, but not limited to, linear, bent and curved geometries. The LED plug-in lamp, consists of a plug head with contact pins that are configured to fit into a matched plug socket or matched plug-in power outlet to power the LED light engine. The LED plug-in lamp illustrated herein has a single plug head. However, it will be clear to one skilled in the art that the present invention can have applications for LED plug-in lamps with multiple plug heads.

The plug head preferably has a fixed stage structure with protruding contact pins. In operation, at least a portion of the protruding contact pins retract within the plug-head through corresponding pin holes on the fixed stage structure. It is understood the pin contacts are in electrical communication with the LED light engine through all the necessary circuitry and wiring including, but not limited to, LED drivers, LED dimmer drivers or any other wiring and circuitry required to power and operate the LED light engine through the matched plug socket or matched plug-in power outlet.

In accordance with an embodiment of the invention, the LED plug-in lamp includes a mechanical lever mechanism coupled to a portion of the contact pins for mechanically retracting the portion of the contact pins with the plug-in head. Alternatively, the LED plug-in lamp includes a wedge lever mechanism that retracts the portion of the contact pins within the plug-head. Regardless of the mechanism employed, the LED plug-in lamp preferably include a collar structure that rotates relative to the fixed stage structure which facilities, allows, or causes the portion of contact pins to retract into the plug head.

In accordance with a preferred embodiment of the invention, the plug head is a G24-type plug head that is capable of being converted from a G24Q 4-pin plug head configuration to a G24D type 2-pin plug head configuration when a collar structure on the plug head is rotated. Accordingly, the LED plug-in lamp of the present invention is compatible for use with light fixtures having electronic or digital ballasts and magnetic ballasts. The conversion from the G24Q 4-pin plug head to a G24D type 2-pin plug head can be reversible.

In accordance with an embodiment of the invention, the LED plug-in lamp includes a plug head with a fixed stage structure, two retractable contact pins, and two fixed contact pins that protrude though a top surface of the fixed stage structure. The two retractable contact pins and the two fixed contact pins are in electrical communication with the LED light engine, as described above. The LED plug-in lamp also includes a collar structure that attaches to a bottom surface of the fixed stage structure through clip features, and is configured to be rotated relative to the fixed stage structure.

The collar structure preferably has two angled pin hole cover features with pin hole cover ends and two pin stop features. In operation, the two pin-stop features hold the two retractable contact pins fixed in a protruding position with the collar structure in a first position relative to the fixed stage structure. Rotating the collar structure relative to the fixed stage structure to a second position moves the two pin-stop structures out from under bottom portions of the two retractable contact pins such that the two of the contact pins can be retracted through the fixed stage structure through corresponding pin holes. Then, rotating the collar structure relative to the fixed stage structure to a third position, places the pin hole cover ends of the two angled pin hole cover features over the corresponding pin holes on the fixed stage. In further embodiments of the invention the ends of the two retractable contact pins include end guide features that fit into and move through matched channel guide structures on the fixed stage structure when the two retractable contact pins are being retracted, as described above.

Figures 1A, 1B:
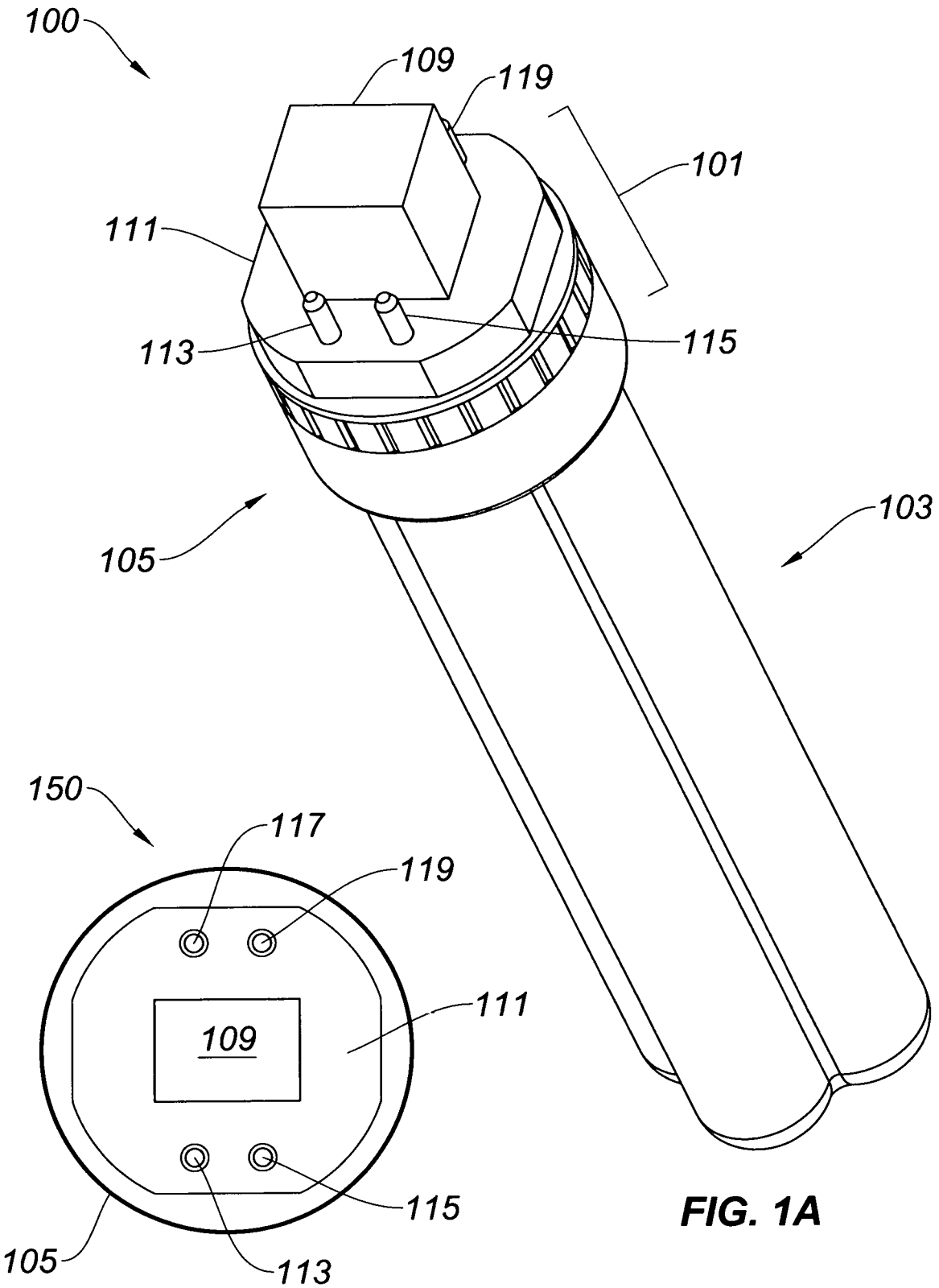
FIGS. 1A-B show a perspective and a top view of an LED plug-in lamp with G24Q 4-pin plug head, respectively.

DETAILED DESCRIPTION OF THE INVENTION:

FIGS. 1A-B show a perspective view 100 and top view 150 of an LED plug-in lamp with G24Q 4-pin plug head 101. The plug head 101 is electrically coupled to an LED light engine 103 through circuitry and wiring, including, but not limited, to LED divers and LED dimmer drivers. The plug head 101 has four contact pins 111, 115, 117 and 119 protruding from a top surface of a stage structure 111. The stage structure includes a protruding fitted insert 109 that along with the four contact pins 113, 115, 117 and 119 fit into a matched G24Q plug-in socket or power outlet for powering the LED plug-in lamp. Attached to a bottom portion of the stage structure 111 there is a collar structure or housing structure 105 that can house necessary wiring or circuitry.

Figures 2A, 2B:
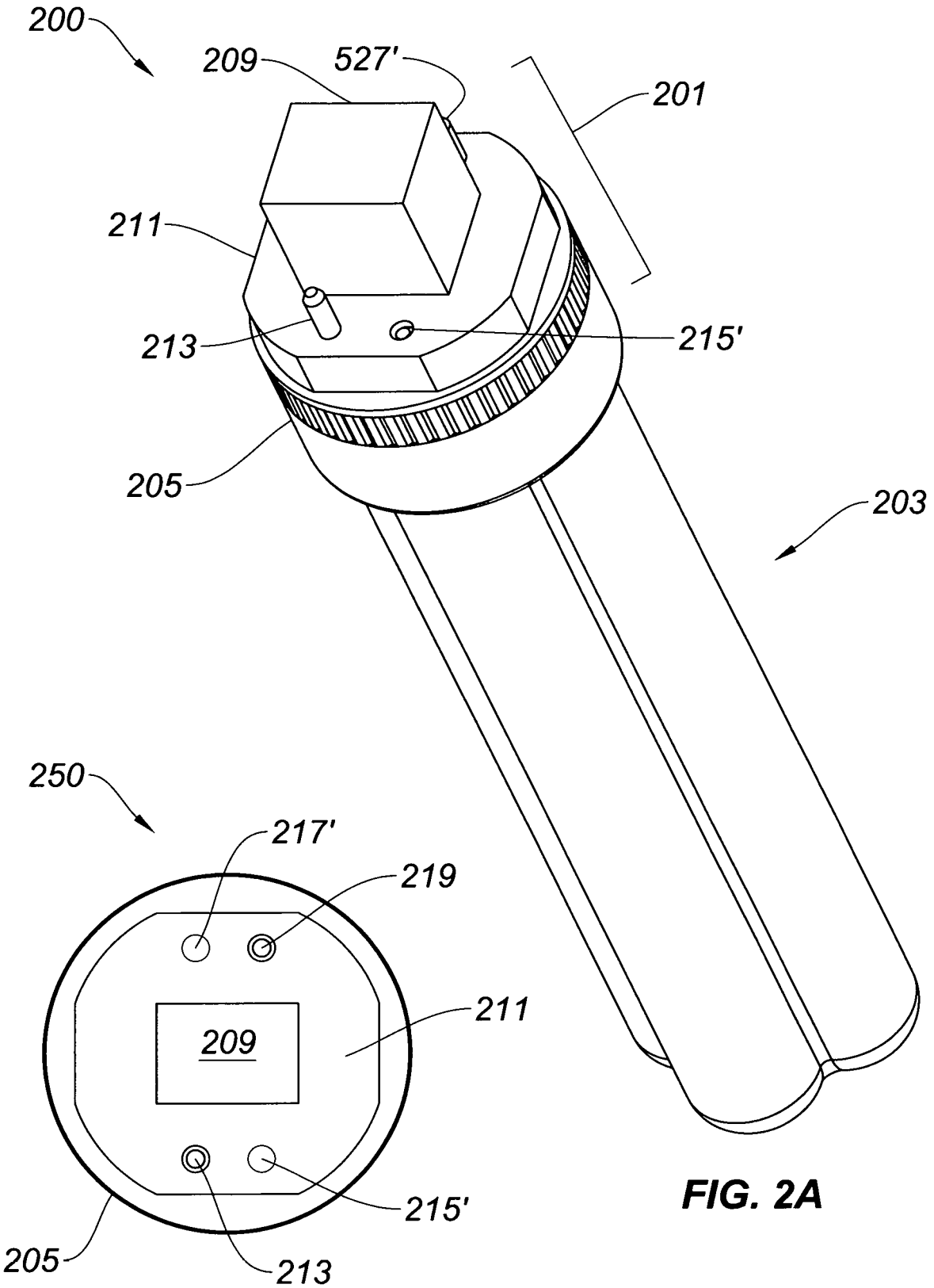
FIGS. 2A-B show a perspective and a top view of an LED plug-in lamp with G24Q 4-pin plug head that has been converted to a G24D 2-pin plug head, in accordance with the embodiments of the invention.

FIGS. 2A-B show a perspective view 200 and top view 250 of an LED plug-in lamp with G24Q 4-pin plug head 201 that has been converted to a G24D 2-pin plug head. As described above, the plug head 201 is electrically coupled to an LED light engine 203. The plug head 101 has 2 contact pins 213 and 219 protruding from a fixed or stationary stage structure 211 along with a protruding fitted insert 209. The plug head 201 is configured to fit into a matched G24D plug-in socket or power outlet for powering the LED plug-in lamp 200. In accordance with the embodiments of the invention two contact pins are retracted into the plug head 201 by rotating a collar structure 205 relative to the fixed or stationary stage structure 211 resulting in two unoccupied pin holes 215' and 217'. A number of mechanisms that facilitate, allow or cause contact pins to retract into the plug head 201 are envisioned and described below.

FIGS. 3A-D show schematic representations of a LED plug-in lamp plug head 301 with a mechanical lever mechanism 307 for retracting a contact pin 313 into the LED plug-in lamp plug head 301, in accordance with the embodiments of the invention. In the position shown in FIG. 3A, the contact pin 313 is supported by the lever mechanism 307 and protrudes through a pin hole 312 from a stage structure 311. The contact pin 313 is electrically couple to a LED light engine 323 through appropriate wiring and circuitry 321 to power the LED light engine. Coupled to a bottom portion of the stage structure 311 is a collar structure 305.

Figure 3A:
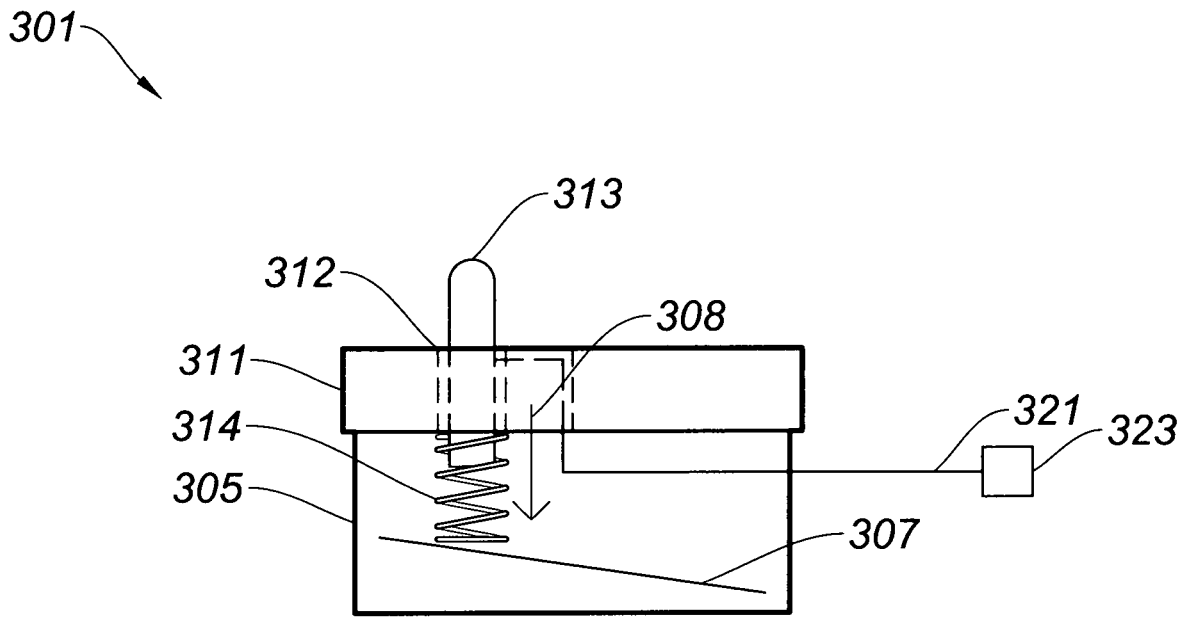
FIGS. 3A-D illustrate schematic representations of an LED plug-in lamp plug head with a lever for mechanically retracting contact pins within the LED plug-in lamp plug head, in accordance with the embodiments of the invention.
Figure 3B:
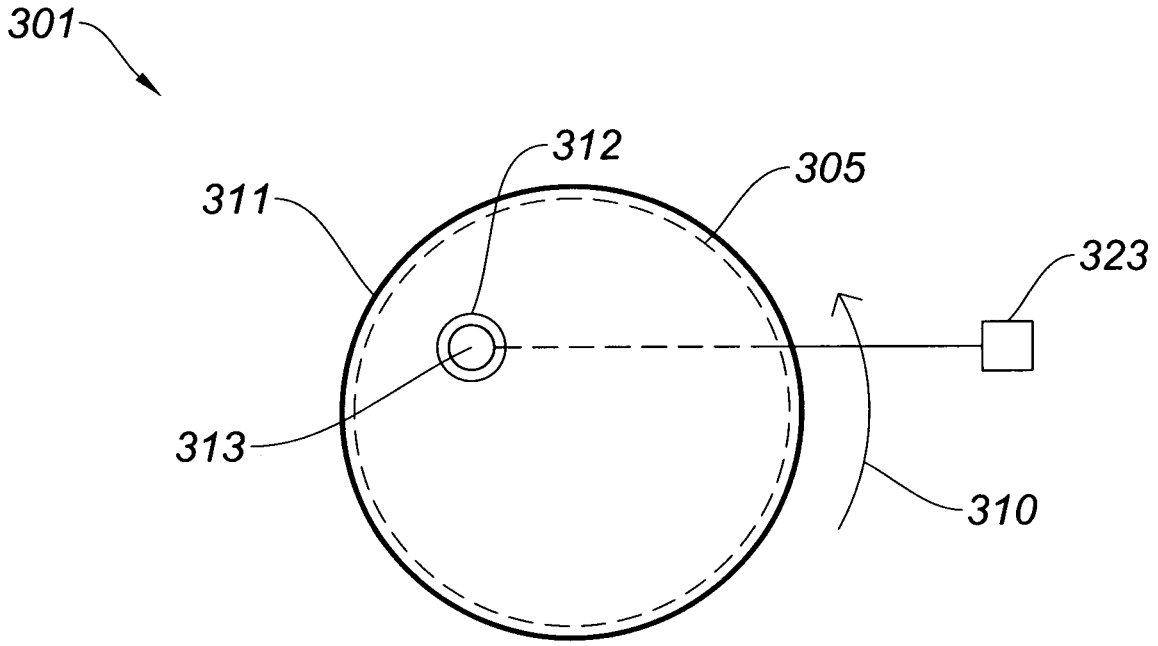
Figure 3C:
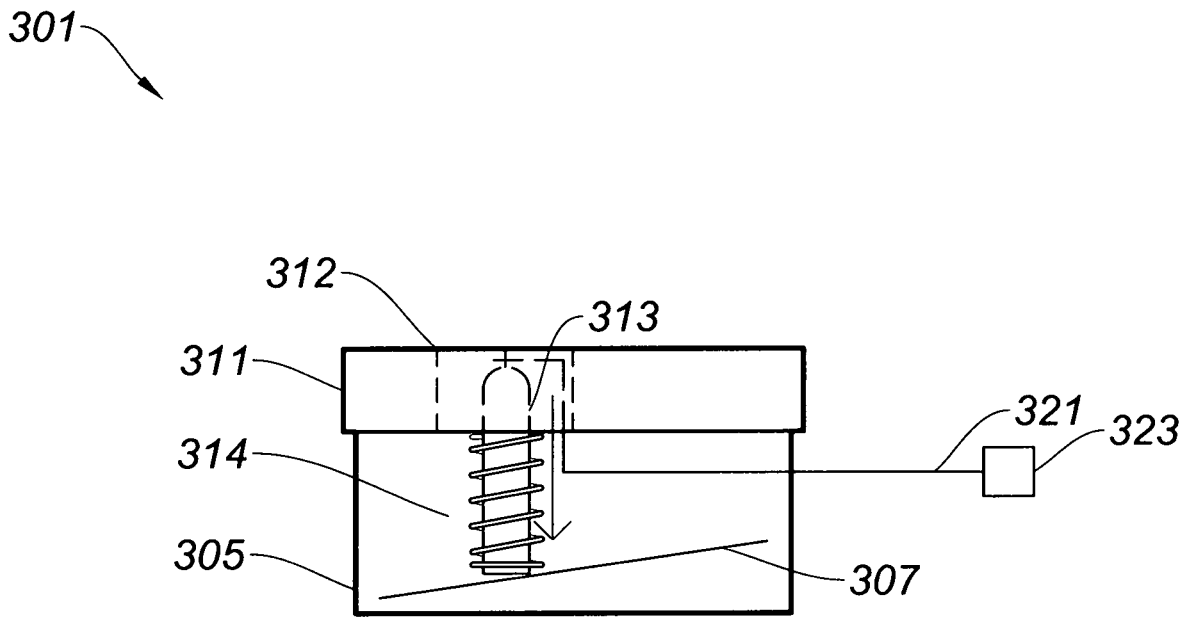

Referring to FIG. 3B, rotating the collar structure 305, as indicated by the arrow 310, relative to the stage structure causes the lever mechanism 307 to move downward, as indicated by the arrow 308 and shown in FIG. 3C. With the lever mechanism 307 in the downward position, the contact pin 313 can be retracted into the LED plug-in lamp plug head 301 and can be electrically disconnected from the LED light engine 323. In accordance with the embodiments of the invention, the contact pin 313 includes a spring 314 that urges the contact pin 313 into the retracted position shown in FIG. 3C when the lever mechanism 307 placed in the lowered position by rotating the collar structure 305.

Figure 3D:
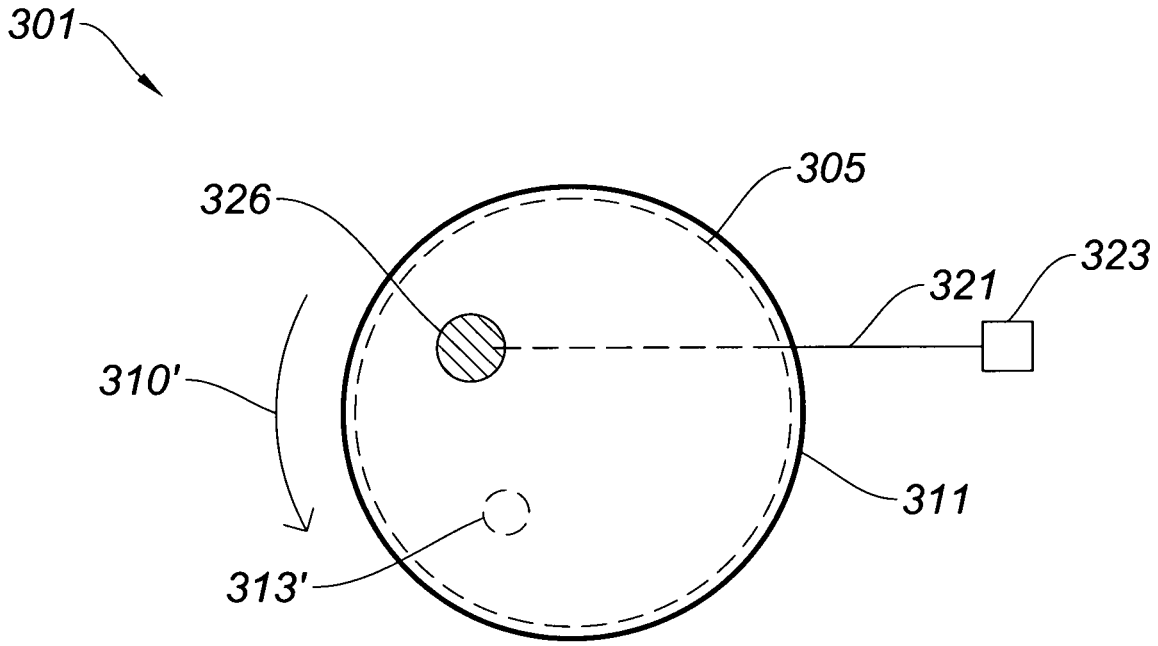

Referring to FIG. 3D, rotating the collar structure 305 farther as indicated by the arrow 310', a pin hole cover feature 326 is placed over the unoccupied or vacated pin hole 312. In yet further embodiments of the invention, the contact pin 313 is moved to a new position 313' within the LED plug-in lamp plug head 301. Also the contact pin 313 can be placed back into a protruding position as shown in FIG. 3A by rotating the collar structure 305 relative to the stage structure 311 in a direction that is opposite to the direction of the arrow 310.

FIGS. 4A-D illustrate schematic representations of an LED plug-in lamp plug head 401 with a wedge lever mechanism 407 that retracts a contact pin 413 within the plug head 401 through a contact pin hole 412. As described previously, the contact pin 413 is electrically coupled to a LED light engine through the appropriate wiring and circuitry to power and operate the LED light engine.

Figure 4A:
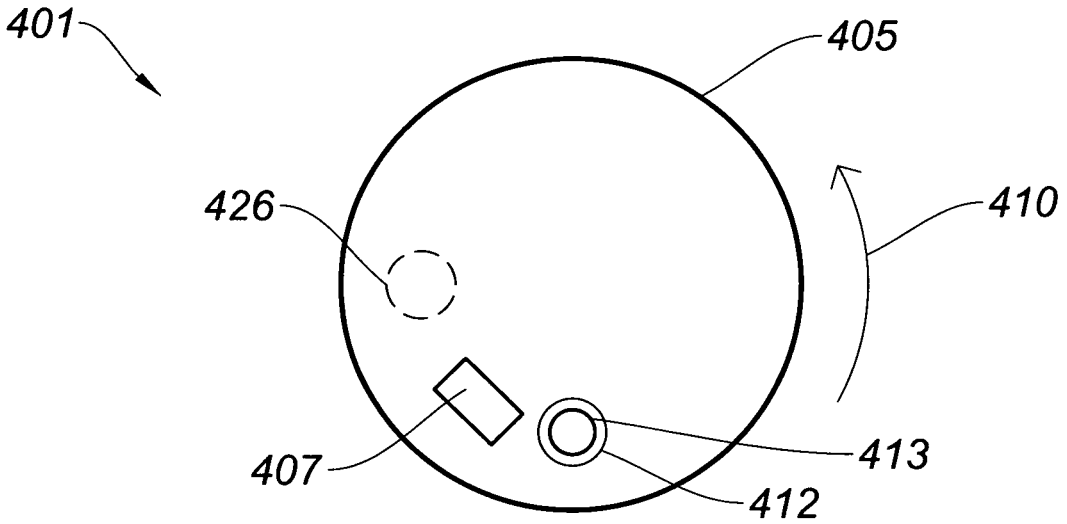
FIGS. 4A-D illustrate schematic representations of an LED plug-in lamp plug head with a wedge lever that retracts contact pins within the plug head, in accordance with the embodiments of the invention.
Figure 4B:
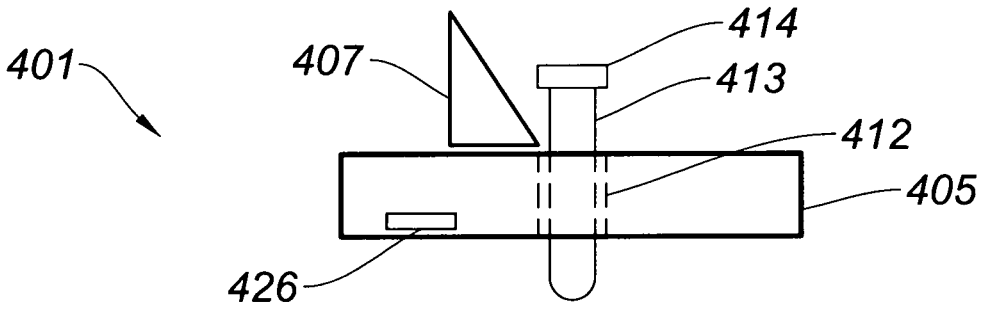
Figure 4C:
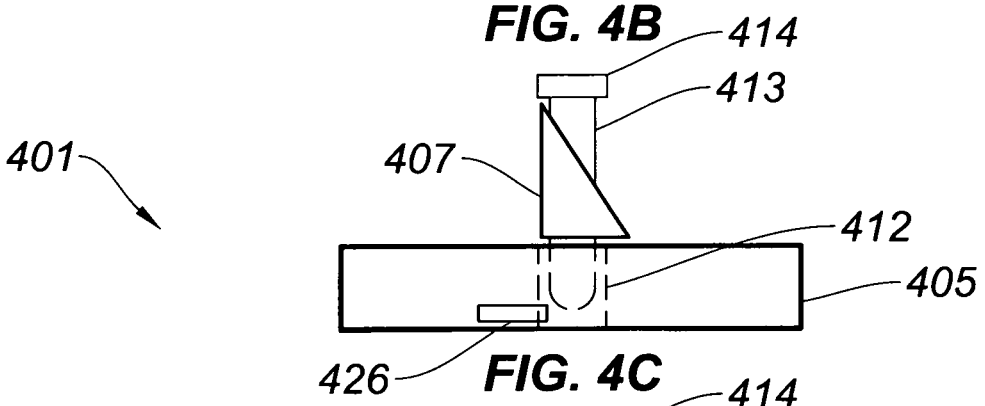
Figure 4D:
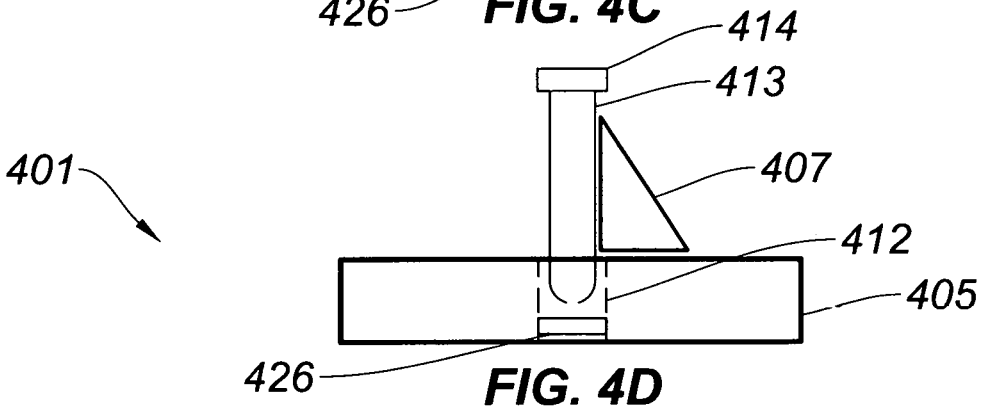

Referring to FIG. 4B, rotating a collar structure 405, as indicated by the arrow 410, causes the wedge lever mechanism 407 to wedge under portion 414 of the contact pin 413 and pushes or urges the contact pin 413 to recede through the pin hole 412 on the LED plug-in lamp plug head 401, as shown in FIG. 4C. Continuing to rotate the collar structure 405 farther, places pin hole cover feature 426 over the contact pin hole 412. Regardless of the mechanism employed, the LED plug-in lamp preferably includes a collar structure that rotates relative to a fixed stage structure that facilities, allows, or causes one or more contact pins to retract into LED plug-in lamp plug head.

FIGS. 4E-H illustrate schematic representations of an LED plug-in lamp plug head 451 where a contact pin 463 can retract through a contact pin hole 462 by changing the location of a sliding support and cover mechanism 453 of a contact pin support/cover feature 458 within a plug head base 452. As described previously, the contact pin 463 is electrically coupled to a LED light engine through the appropriate wiring and circuitry to power and operate the LED light engine.

Figure 4E:
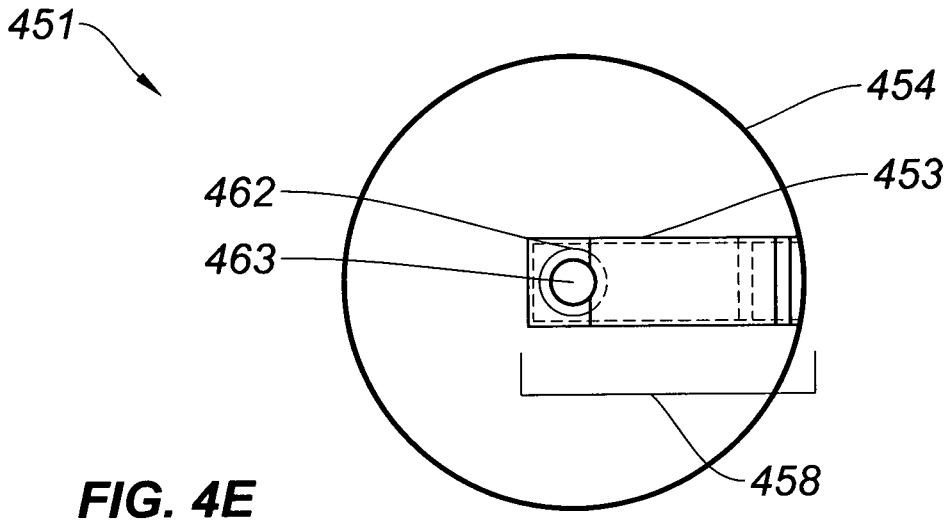
FIGS. 4E-H illustrate schematic representations of an LED plug-in lamp plug head where contact pin can retract through a contact pin hole by changing the location of a sliding support and a cover mechanism of a contact pin support/cover feature within a plug head base, in accordance with an alterative embodiment of the invention.
Figure 4F:
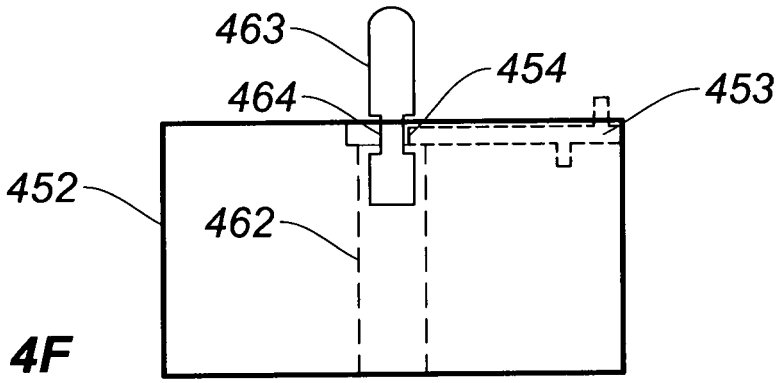

FIGS. 4E-F illustrates the initial location of contact pin support/cover feature 458. In this location, the end 454 of sliding support and cover mechanism 453 slots into the notched 464 of contact pin 463, keeping the contact pin in an active position protruding from base structure 452.

Figure 4G:
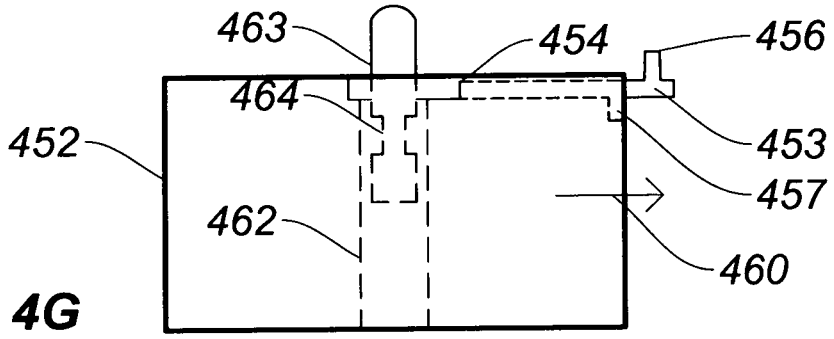
Figure 4H:
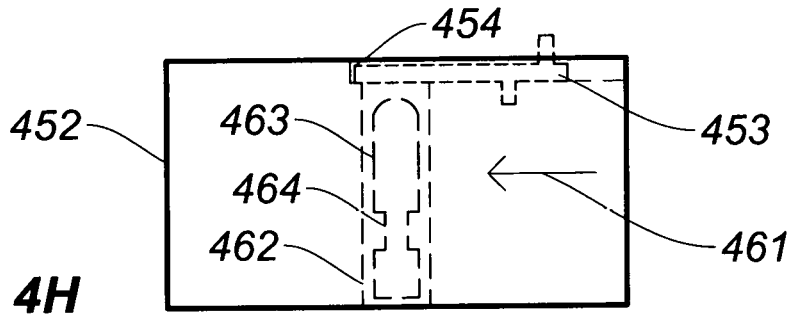

Referring to FIG. 4G, manipulating tab 456 of sliding mechanism 453 in the direction of arrow 460, separates the support edge feature 454 and notch portion 464 of the contact pin 463, allowing the contact pin 463 to recede through the pin hole 462 on the LED plug-in lamp plug head 451, as shown in FIG. 4H. Once the contact pin has dropped into the base unit, sliding mechanism 453 returns in the direction of arrow 461, placing edge feature 454 over the contact pin hole 462 and effectively becoming a cover feature 476 for the pin hole unit. Regardless of the mechanism employed, the LED plug-in lamp preferably includes a support/cover feature that slides relative to a fixed stage structure that facilities, allows, or causes or allows one or more contact pins to retract into LED plug-in lamp plug head.

Figure 5A:
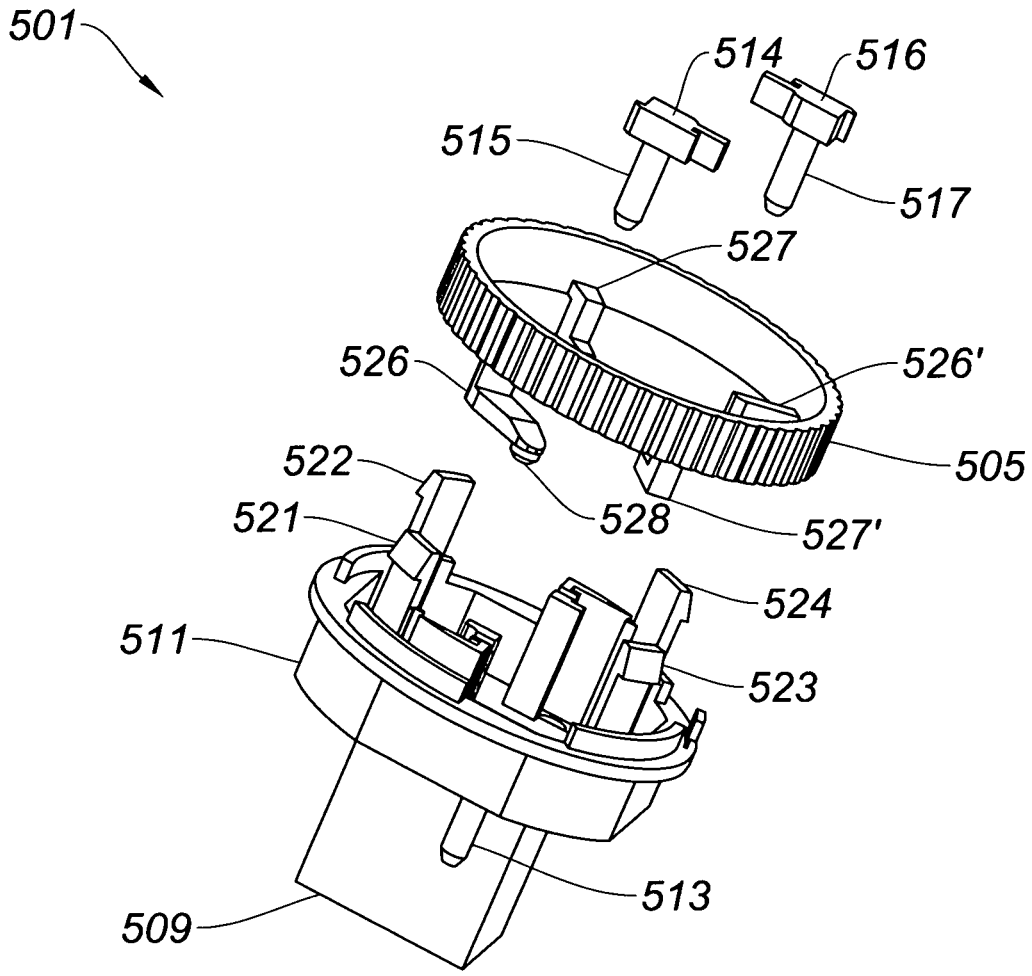
FIGS. 5A-B show views of a rotating collar structure that attaches to a fixed stage structure to form a LED plug-in lamp plug head with pin contacts that retract, in accordance with the embodiments of the invention.
Figure 5B:
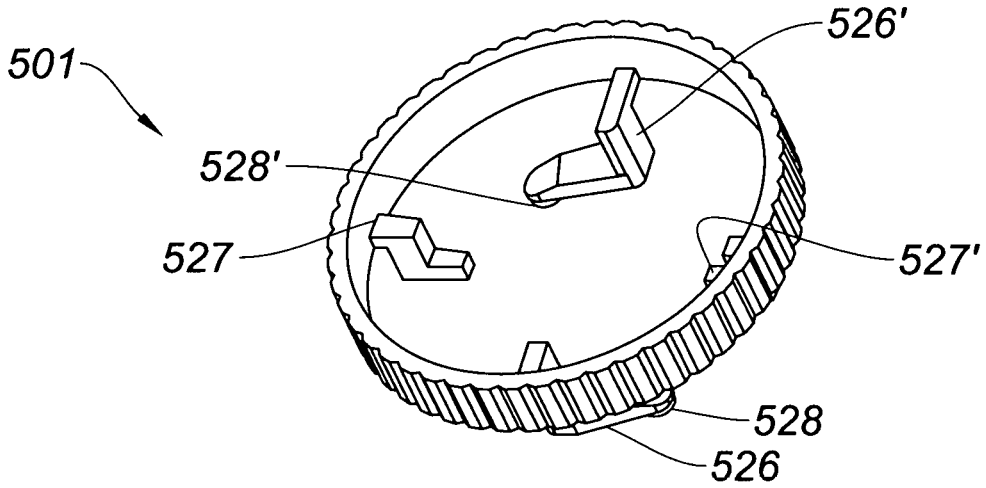

Referring now to FIGS. 5A-B, a LED plug-in lamp plug head 501 that converts from a 4-pin plug head to a 2-pin plug head includes a stage structure 511 and a collar structure 505. The collar structure 511 includes two pin-stop features 527 and 527' and two pin hole cover features 526 and 526' with pin hole covers 528 and 528'. The stage structure 511 has a fitted rectangular protrusion 509, two fixed contact pins 513 (such as the fixed contact pins 213 and 219 shown in FIG. 2A) and clip features 521, 522, 523 and 524 protruding from a bottom surface of the stage structure 511. The LED plug-in lamp plug head 501 also includes two retractable contact pins 515 and 517 with end guide features 514 and 516. The LED plug-in lamp plug head 501 is assembled by attaching the collar structure 505 to the stage structure 511 through the clip features 521, 522, 523 and 524, such that the collar structure 505 can rotated relative to the stage structure 511. The two retractable contact pins 515 and 517 fit into matched channel guide structures 529 and 529', shown in FIGS. 6A-D. It is understood that the two fixed contact pins 513 and the two retractable contact pins 515 and 517 are electrically coupled all the necessary wiring and circuitry to power a LED light engine, such as the light engines 103 and 203 illustrated in FIGS. 1A and 2A.

Figure 5C:
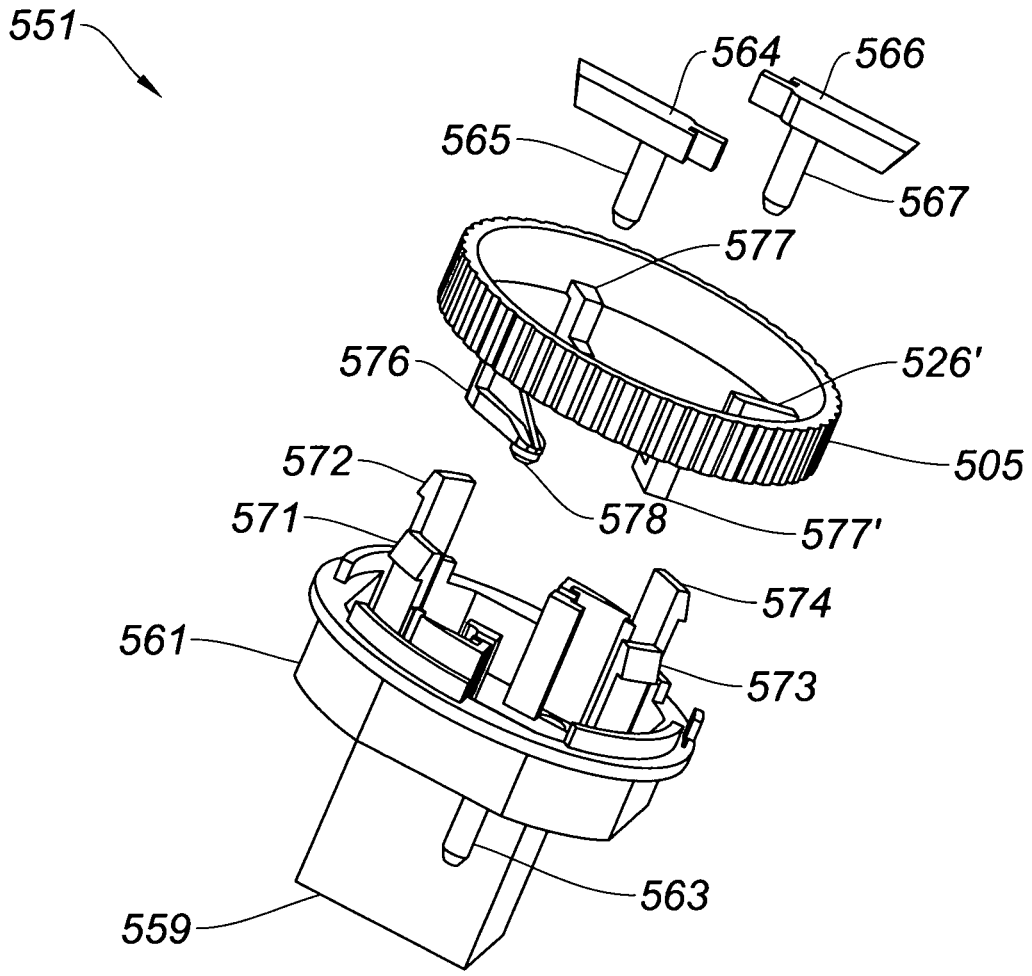
FIGS. 5C-D illustrated an LED plug-in lamp plug head that converts from a 4-pin plug head to a 2-pin plug head that includes a stage structure and a collar structure, in accordance with the embodiments of the invention.
Figure 5D:
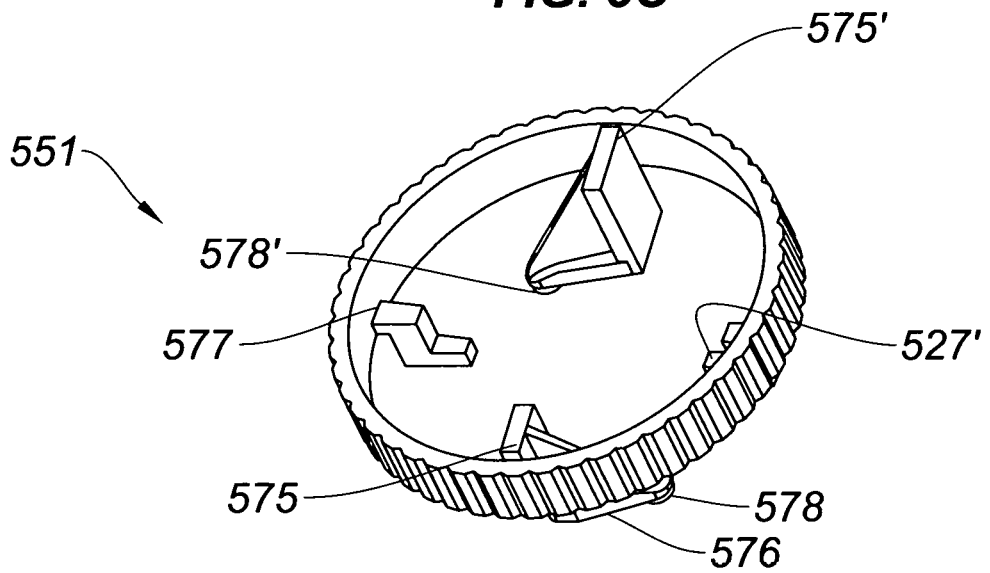

Referring now to FIGS. 5C-D showing an alternative LED plug-in lamp plug head 551 that converts from a 4-pin plug head to a 2-pin plug head includes a stage structure 561 and a collar structure 555. The collar structure 561 includes two pin-stop features 577 and 577' and two triangular pin hole cover features 576 and 576' with top portions 575 and 575' and with pin hole covers 578 and 578'. The stage structure 561 has a fitted rectangular protrusion 569, two fixed contact pins 563 (such as the fixed contact pins 263 and 269 shown in FIG. 2A) and clip features 571, 572, 573 and 574 protruding from a bottom surface of the stage structure 561. The LED plug-in lamp plug head 551 also includes two retractable contact pins 565 and 567 with elongated guide features 564 and 566. The LED plug-in lamp plug head 551 is assembled by attaching the collar structure 555 to the stage structure 561 through the clip features 571, 572, 573 and 574, such that the collar structure 555 can rotated relative to the stage structure 561. The two retractable contact pins 565 and 567 fit into matched channel guide structures 579 and 579', shown in FIGS. 6A-D. It is understood that the two fixed contact pins 553 and the two retractable contact pins 565 and 567 are electrically coupled all the necessary wiring and circuitry to power a LED light engine, such as the light engines 103 and 203 illustrated in FIGS. 1A and 2A. In operation, when the two retractable contact pins 565 and 567 are retracted within the LED plug-in lamp plug head 551, such as described below, the elongated guide features 564 and 566 are seated on the top portions 575 and 575' of the triangular pin hole cover features 576 and 576' to thereby help secure the retractable contact pins 565 and 567 in the retracted position.

Figure 6A:
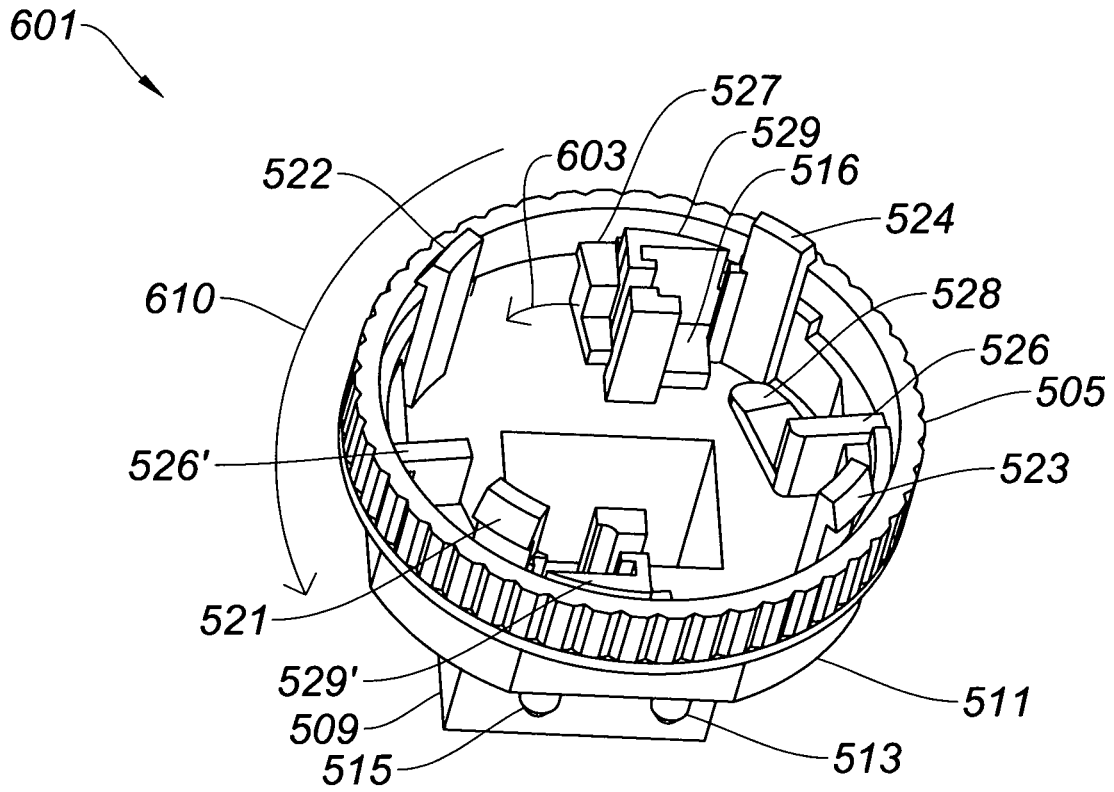
FIGS. 6A-D illustrate the operation of a G24Q 4-pin plug head type configuration being converted to a G24D 2-pin plug head type configuration by rotating the collar structure shown in FIG. 5B relative to a fixed stage structure of the LED plug-in lamp plug head, in accordance with the embodiments of the invention.
Figure 6B:
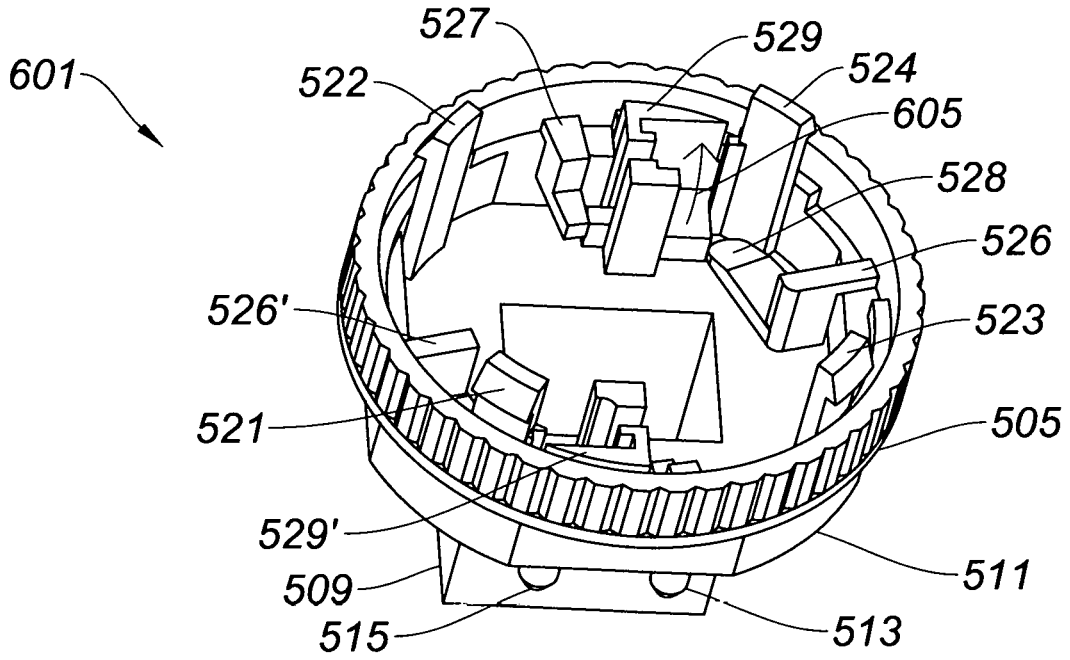

FIGS. 6A-D show an assembled LED plug-in lamp plug head 601. The assembled LED plug-in lamp plug head 601 includes the collar structure 511 with pin-stop features 527 and 527' and two pin hole cover features 526 and 526' with pin hole covers 528 and 528', such as described above. The assembled LED plug-in lamp plug head 601 also includes the stage structure 505 with a fitted rectangular protrusion 509, two fixed contact pins 513 and clip features 521, 522, 523 and 524 protruding from a bottom surface of the stage structure 511. As shown in FIG. 6A, the two retractable contact pins 515 and 517, with end guide features 514 and 516, are fitted into the matched channel guide structures 529 and 529'.

Figure 6C:
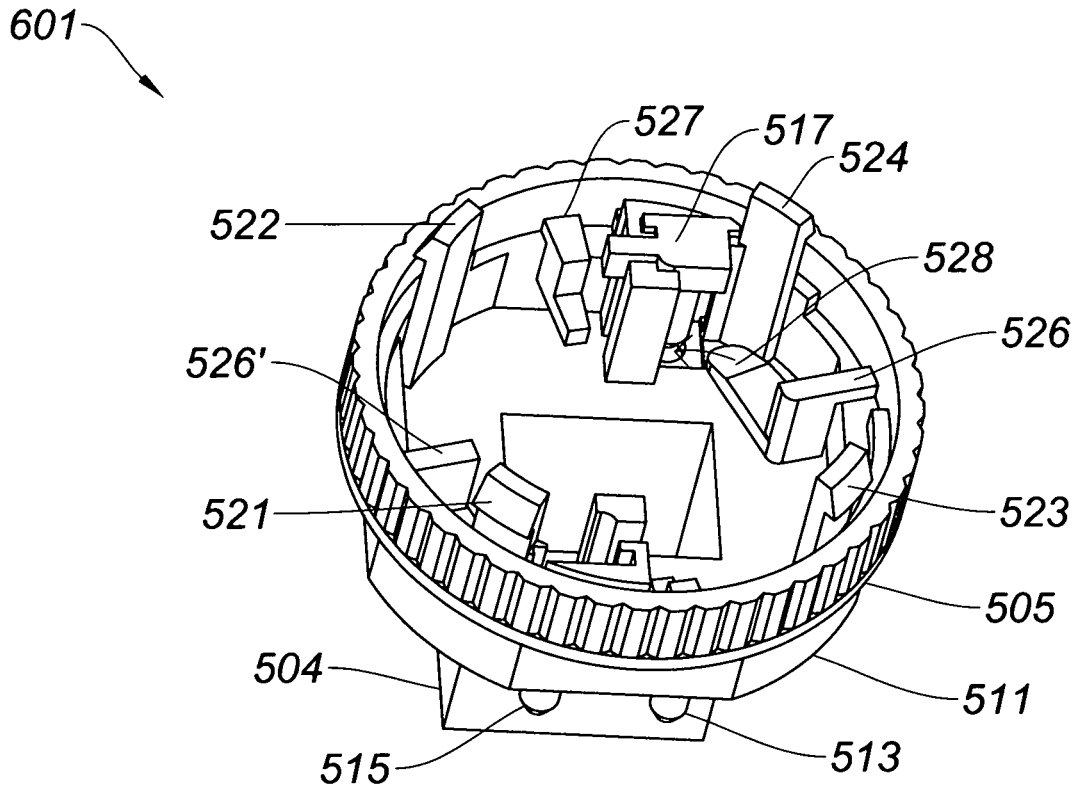
Figure 6D:
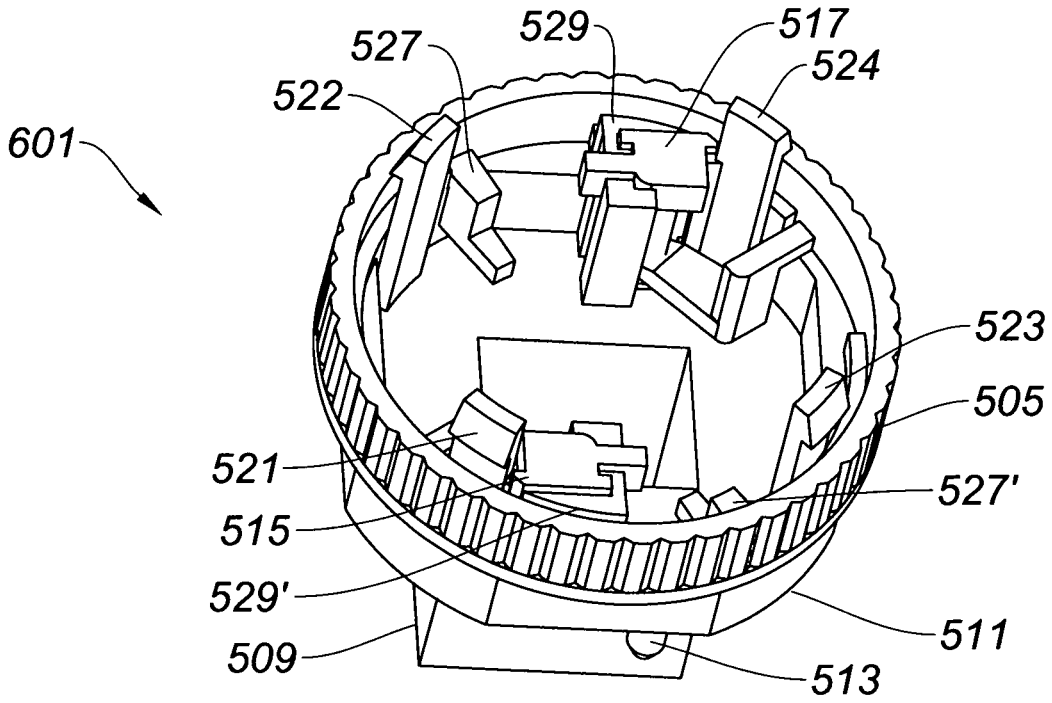

With the collar structure in first position shown in FIG. 6A, the pin-stop features 527 and 527' hold or secure the two retractable contact pins 515 and 517 in a protruding position from the top surface of the stage structure 511 through corresponding pin holes, such as shown in FIG. 1A. Rotating the collar structure 505 to a second position, as indicated by the arrows 610 and 603, move the pin-stop features 527 and 527' such that the two retractable contact pins 515 and 517 can be retracted into the assembled LED plug-in lamp plug head 601 through corresponding pin holes by moving the end guide features 514 and 516 within the matched channel guide structures 529 and 529'. The retractable contact pins 515 and 517 can be retracted automatically through a spring or any other suitable mechanism, and/or can be manually pushed into a retracted position, as indicated by the arrow 605. Once retractable contact pins 515 and 517 are in the retracted position within the lamp plug head 601, as shown in FIG. 6C, the collar structure can be rotated farther to a third position in the direction of the arrow 610 and shown in FIG. 6D, thereby placing the pin hole covers 528 and 528' eclipsed with or over corresponding pin holes on the stage structure 511 that have been vacated by the recessed retractable contact pins 515 and 517.

The present invention has been described in terms of specific embodiments incorporating details to facilitate the understanding of the principles of construction and operation of the invention. For example, the plug-in lamp plug head can be configured to reversibly convert between G24Q a 4-pin plug head configuration and G24D type 2-pin plug head configuration. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. An LED plug-in lamp comprising:

a) an LED light engine; and b) a plug head with contact pins in electrical communication with the LED light engine and the plug head being configured to plug into a matched plug-in power outlet to power the LED light engine, wherein a portion of contact pins retract within the plug-head through corresponding pin holes, wherein the plug head is converted from a G24Q 4-pin plug head to a G24D type 2-pin plug head when a collar structure on the plug head is rotated.

2. The LED plug-in lamp of claim 1, further comprising a mechanical lever coupled to the portion of contact pins for mechanically retracting the portion of the contact pins.

3. The LED plug-in lamp of claim 2, wherein the portion of the contact pins retract within the plug-head when a collar structure on the plug head is rotated.

4. The LED plug-in lamp of claim 3, further comprising pin hole cover structures that are positioned over the corresponding pin holes when the collar structure is rotated.

5. The LED plug-in lamp of claim 1, further comprising a wedge lever that retracts the portion of the contact pins within the plug-head through corresponding pin holes when a collar structure on the plug head is rotated.

6. The LED plug-in lamp of claim 5, further comprising pin hole cover structures that are positioned over the corresponding pin holes when the collar is rotated.

7. An LED plug-in lamp comprising:

a) an LED light engine;

b) a plug head with a fixed stage and four contact pins that protrude though a top surface of the fixed stage structure and are in electrical communication with the LED light engine; and c) a collar structure that attaches to a bottom surface of the fixed stage structure and is configured to rotate, wherein rotating the collar structure allows two of the four contact pins to be retracted into the plug head through two corresponding pin holes on the fixed stage and thereby convert the plug head from a G24Q-type four pin plug head to a G24D type 2-pin plug head.

8. The LED plug-in lamp of claim 7, wherein the collar includes pin hole cover structures whereby rotating the collar structure cause the pin hole cover structures to eclipse the corresponding pin holes on the fixed stage structure.

9. The LED plug-in lamp of claim 8, wherein collar structure is attached to the bottom surface of the fixed stage structure through clip features.

10. The LED plug-in lamp of claim 9, the fixed stage structure includes channel guides for holding the two contact pins of the four contact pins and wherein the two contact pins of the four contact pins retract into the plug head through the channel guides.

11. An LED plug-in lamp comprising:

a) an LED light engine; and b) a plug head with a stage structure and two retractable contact pins and two fixed contact pins that protrude though a top surface of the stage and that are in electrical communication with the LED light engine; and c) a collar structure that attaches to a bottom surface of the stage structure and is configured to be rotated relative to the stage structure, the collar structure having two angled pin hole cover features with pin hole covers and two pin-stop features, wherein the two pin-stop features hold the two retractable contact pins fixed with the collar structure in a first position and wherein rotating the collar structure to a second position moves the two pin-stop features such that the two reachable contact pins can be retracted through the stage structure through corresponding pin holes on the stage and rotating the collar structure to a third position places pin hole covers over the corresponding pin holes.

12. The LED plug-in lamp of claim 11, wherein the plug head is a G24-type plug head.

13. The LED plug-in lamp of claim 11, wherein collar structure is attached to the bottom surface of the stage structure through clip features.

14. The LED plug-in lamp of claim 11, wherein ends of the two retractable contact pins include end guide features that move through matched channel guide structures on the stage structure when the two retractable contact pins are being retracted.

* * * * *